US006684436B1

(12) United States Patent
Lovelace

(10) Patent No.: US 6,684,436 B1
(45) Date of Patent: Feb. 3, 2004

(54) FOLDING MATTRESS STRUCTURE

(76) Inventor: Doug Lovelace, 1811 Broadway St., Concord, CA (US) 94520

( * ) Notice: Subject to any disclaimer, the term of this patent is extended or adjusted under 35 U.S.C. 154(b) by 0 days.

(21) Appl. No.: 10/122,961

(22) Filed: Apr. 11, 2002

(51) Int. Cl.[7] ..... A47C 27/07
(52) U.S. Cl. ..... 5/722; 5/716
(58) Field of Search ..... 5/722, 723, 716, 5/249, 691; 267/91, 95, 106

(56) References Cited

U.S. PATENT DOCUMENTS

| | | | | | |
|---|---|---|---|---|---|
| 31,936 | A | * | 4/1861 | Seidler | 5/722 X |
| 74,528 | A | * | 2/1868 | Gebhard | 5/716 |
| 92,396 | A | * | 7/1869 | Sulzbacher | 5/716 |
| 149,758 | A | | 4/1874 | Junge | |
| 274,963 | A | * | 4/1883 | Olander | 5/716 |
| 428,637 | A | * | 5/1890 | Schmitt | 5/249 |
| 499,941 | A | * | 6/1893 | Schmitt | 5/249 |
| 787,450 | A | | 4/1905 | Jacobs | |
| 877,568 | A | | 1/1908 | Innes | |
| 1,002,006 | A | * | 8/1911 | Stapely | 5/716 |
| 1,185,575 | A | * | 5/1916 | Anthony | 5/249 |
| 1,274,397 | A | * | 8/1918 | Dyett | 5/249 |
| 1,549,289 | A | * | 8/1925 | Bradley | 5/722 X |
| 1,554,098 | A | | 9/1925 | Kaiserman | |
| 1,607,420 | A | * | 11/1926 | Williams | 5/722 X |
| 2,033,841 | A | | 3/1936 | Maddux | |
| 2,118,297 | A | * | 5/1938 | Douglas | 5/249 |
| 2,249,266 | A | * | 7/1941 | Bell | 5/722 X |
| 2,279,286 | A | * | 4/1942 | Bell | 5/722 X |
| 2,547,840 | A | * | 4/1951 | Smith | 5/722 |
| 2,593,678 | A | * | 4/1952 | Johnson | 5/716 |
| 3,142,848 | A | * | 8/1964 | Blecker | 5/722 X |
| 3,176,325 | A | * | 4/1965 | Levine | 5/249 |
| 3,249,952 | A | * | 5/1966 | Janapol | 5/716 |
| 3,316,568 | A | * | 5/1967 | Janapol | 5/716 |
| 3,538,521 | A | * | 11/1970 | Basner | 5/691 |
| 4,004,305 | A | * | 1/1977 | Rubin | 5/722 X |
| 4,095,296 | A | * | 6/1978 | Ferro | 5/691 X |
| 4,662,011 | A | | 5/1987 | Duvivier | |
| 4,782,540 | A | | 11/1988 | Parker | |
| 4,790,519 | A | | 12/1988 | Stewart | |
| 4,811,932 | A | | 3/1989 | Miller | |
| 5,214,809 | A | * | 6/1993 | Stuart | 5/716 |
| D376,945 | S | | 12/1996 | Bonaddio et al. | |
| 5,657,500 | A | * | 8/1997 | Messina | 5/722 |
| 5,669,093 | A | * | 9/1997 | Ogle et al. | 5/722 X |
| 5,953,778 | A | * | 9/1999 | Hiatt | 5/716 |
| 6,088,857 | A | | 7/2000 | Ogle | |

FOREIGN PATENT DOCUMENTS

| | | | | |
|---|---|---|---|---|
| AT | 27810 | * | 3/1907 | 5/249 |
| DK | 107695 | * | 10/1967 | 5/716 |
| FR | 325928 A | * | 5/1903 | 5/722 |
| GB | 759177 A | * | 10/1956 | 5/722 |

* cited by examiner

*Primary Examiner*—Robert G. Santos
(74) *Attorney, Agent, or Firm*—Theodore J. Bielen, Jr.

(57) ABSTRACT

A folding mattress structure including a first mattress section having an end formed between first and second sides. Likewise, a second section is constructed with first and second sides and an end between the same. The connecting member is linked to the first and second sections by connection between spring members that lie adjacent one another in the separate first and second sections. The connecting member permits pivoting of the first and second section relative to one another by this expedient.

4 Claims, 2 Drawing Sheets

FOLDING MATTRESS STRUCTURE

BACKGROUND OF THE INVENTION

The present invention relates to a novel and useful mattress structure which is capable of folding.

Mattresses are used in sleep or rest related situations throughout the world. Mattresses provide a comfortable platform for a person residing on the same, but are generally rather large and unwieldy, especially when the mattress must be transported by a single person. In addition, mattresses are often too bulky to fit into small passageways for use in rooms within an edifice. Transportation platforms such as boats, trains, automobiles, and the like are often used as living quarters, requiring mattresses. Normal mattresses do not fit in certain transportation platforms. This factor requires special manufacturing of mattresses that are of a miniature size or are divided into multiple pieces for reassembly. Unfortunately, such mattresses are not as comfortable to the user and are quite expensive to produce.

In the past, mattresses which are capable of flexing or folding have been devised. For example, U.S. Pat. Nos. 787,450, 4,662,011, and 4,811,932, show coil spring mattress structures which permit elastic deformation of the same when in use.

U.S. Pat. No. Des. 376,945 shows a foldable mattress in the form of linked fabric enclosed sections.

U.S. Pat. No. 2,033,841 describes a spring mattress which includes foldable sections that are held together by webbing.

U.S. Pat. No. 4,782,540 shows a sleeper sofa mattress that permits folding along certain lines by the use of a clip.

U.S. Pat. No. 877,568 shows a mattress structure which is foldable by the employment of whipped stitching along a crease.

U.S. Pat. Nos. 1,554,098, 4,790,519, and 6,088,857 show folding mattress structures which employ clips along a fold line of separate mattress sections.

U.S. Pat. No. 149,758 describes a spring mattress which folds due to a series of clips along a fold line.

A mattress structure which is capable of folding and yet maintaining integrity and strength would be a notable advance in the sleep structure field of invention.

BRIEF SUMMARY OF THE INVENTION

In accordance with the present invention a novel and useful folding mattress structure is herein provided.

The structure of the present application utilizes a first section having a first side and a second side with a plurality of springs spanning the same. The first and second sides form an end therebetween which extends along first section.

A second section is also similarly formed to the first section, with a first side, second side, and a plurality of springs spanning the same. An end is also formed between the first and second sides completely across the mattress second section.

A connecting member is also employed in the present invention to link the first section to the second section with the ends of the first and second sections in abutment. The connecting member links the plurality of overlapping springs found in adjacent first and second sections along the ends formed by those sections. The connecting member may take the form of a coiled member that wraps around overlapping springs found in the first and second sections. The connecting member would extend along the entire length of the abutted ends of the first and second sections to provide strength.

In addition, a plurality of cross-members may be used between adjacent springs removed from the springs front the ends of the first and second sections, to transversely link them together laterally relative to each connecting member. Such plurality of cross-members adds strength to the mattress section when used without detracting from the foldability of the structure of the present invention.

It may be apparent that a novel and useful folding mattress structure has been hereinabove described.

It is therefore an object of the present invention to provide a folding mattress structure which is capable of folding and unfolding without deteriorating in strength.

Another object of the present invention is to provide a folding mattress structure which folds from an original configuration of multiple adjacent sections to a unitary mattress support quickly and easily.

Another object of the present invention is to provide a folding mattress structure which possesses the attributes of a unitary mattress when extended into a planar mattress support structure.

Yet another object of the present invention is to provide a folding mattress structure which is relatively simple to manufacture and maintain.

Another object of the present invention is to provide a folding mattress structure which is particularly useful in transportation vehicles such as boats, automobiles, trains, and the like.

The invention possesses other objects and advantages especially as concerns particular characteristics and features thereof which will become apparent as the specification continues.

Figure 1:
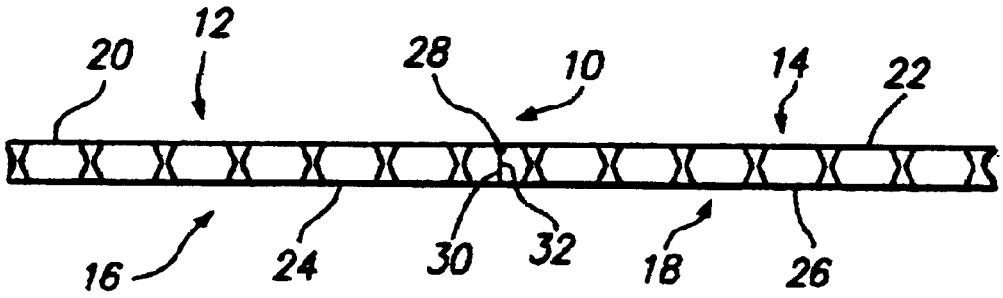
FIG. 1 is a partial side elevational view of the mattress structure of the present invention in its unfolded mode.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which will be fully understood when compared with the prior delineated drawings.

The preferred embodiment of the invention as a whole is shown in the drawings by reference character 10. Folding mattress structure 10 includes a first section 12 and a second section 14, FIGS. 1 and 2. First side 12 possesses a plurality of springs 16. Likewise, second section 14 possesses a plurality of springs 18. Plurality of springs 16 and 18 lie transversely between upper surfaces 20 and 22 of first and second sections 12 and 14, respectively, and lower sides or surfaces 24 and 26 of first and second sections 12 and 14, respectively. First section 12 and second section 14 pivot relative to one another, directional arrow 26 of FIG. 2, along connecting member 28 which lies adjacent ends 30 and 32 of sections 12 and 14, respectively.

Figure 3:
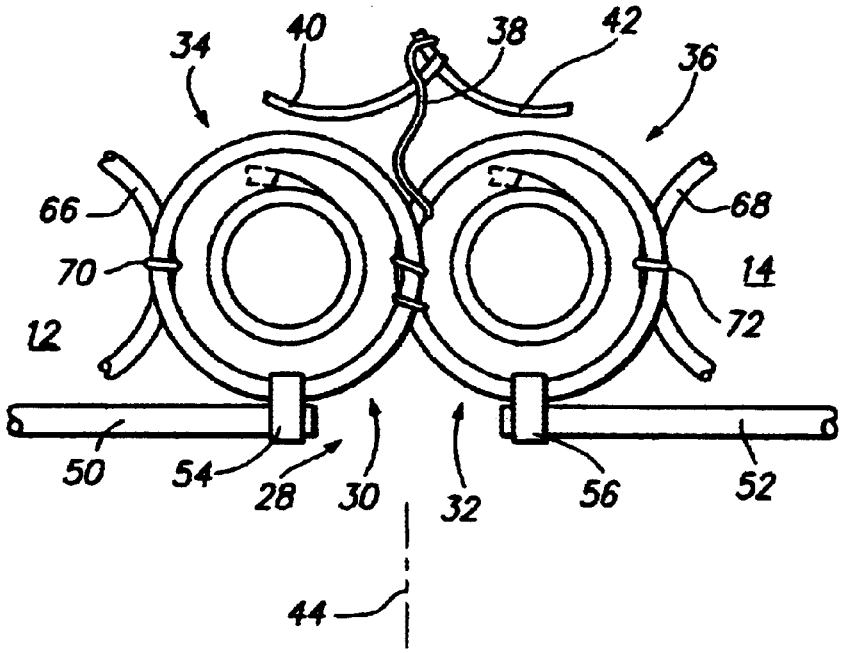
FIG. 3 is a top plan view of a portion of the mattress structure of the present invention showing the connecting member.
Figure 4:
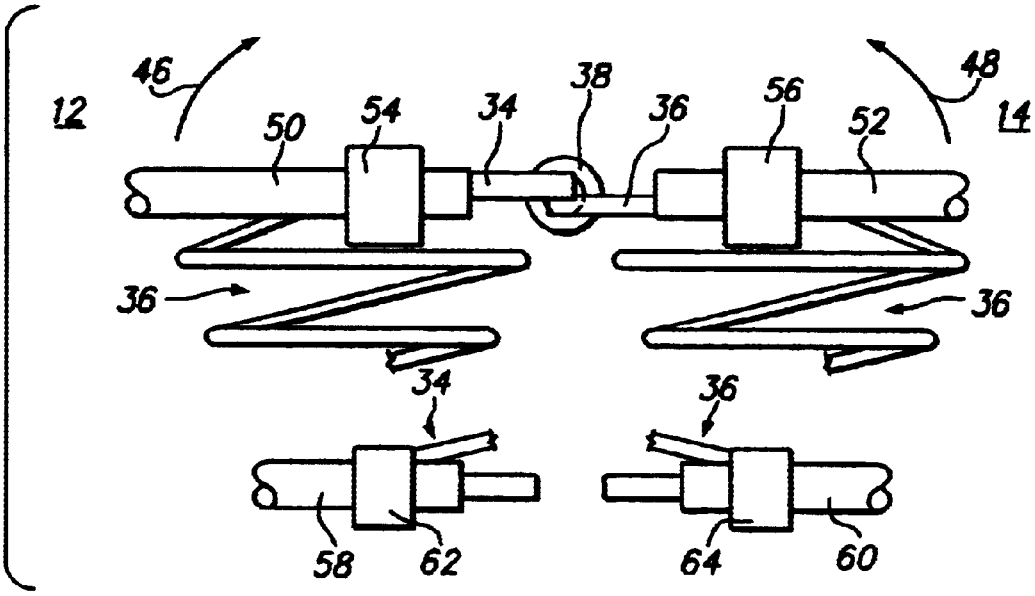
FIG. 4 is a partial side view of the mattress structure of the present invention showing the connecting member and lateral mattress structure.

Turning to FIGS. 3 and 4, it may be observed that the particular structure of connecting member 28 is depicted. Connecting member 28 is depicted as being used in conjunction with a pair of springs 34 and 36. Spring 34 is associated with the plurality of springs 16 of first section 12 while spring 36 is associated with plurality of springs 18 of second section 14. Springs 34 and 36 overlap one another and are connected by elongated member 38 which may be in the form of a metallic cable or wire. Member 38 is capable of wrapping about springs 34 and 36 as well as the remaining pairs of overlapping springs along abutting ends 30 and 32 associated with sections 12 and 14, such as springs 40 and 42. It should be noted that pair of springs 34 and 36 as well as a multiplicity of pairs of springs lying along ends 30 and 32 of sections 12 and 14 are separated by axis 44. Elongated member 38 permits the rotation of first and second sections 12 and 14 according to directional arrows 46 and 48 of FIG. 4.

It should also be apparent that springs 34 and 36 are fastened to perimeter rods 50 and 52 by the use of clamps 54 and 56. Perimeter rods 50 and 52 do not interfere with one another during the folding process heretofore described. In addition, rods 58 and 60 are held to the lower portion of springs 34 and 36 by clamps 62 and 64. It should be noted that rods 50 and 52 as well as rods 58 and 60 are clamped to all plurality of springs lying at the perimeter of sections 12 and 14, respectively. For example, springs 66 and 68, shown partially in FIG. 3, are also clamped to rods 50, 52, 58, and 60.

Moreover, adjacent springs are fixed to one another across structure 10. FIG. 3 shows cross-members 70 and 72 which holds springs 34 and 66 and springs 36 and 68, respectively to one another to add in the support of mattress structure 10.

Figure 2:
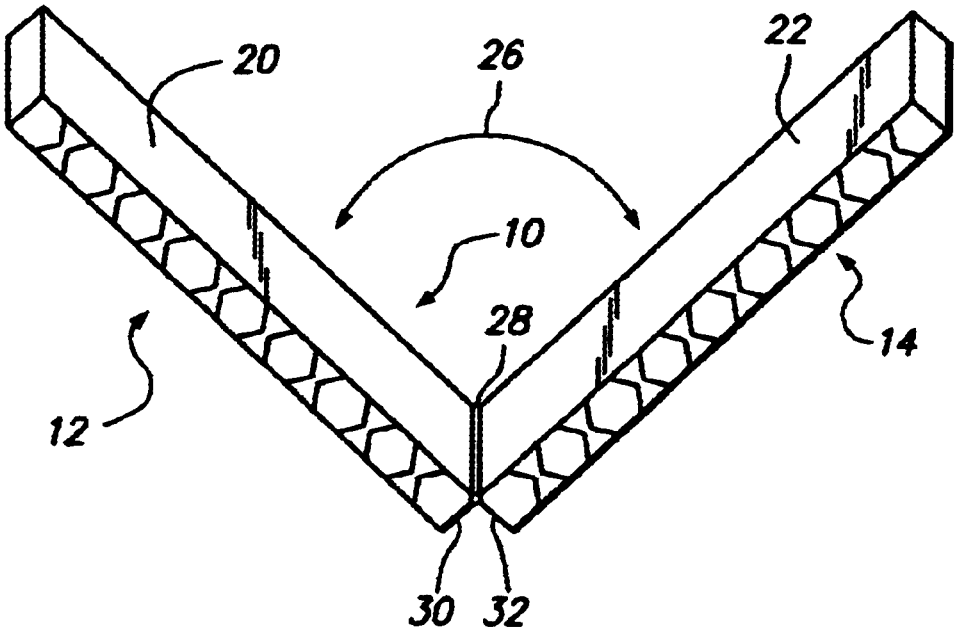
FIG. 2 is a top front perspective view of the mattress structure of the present invention partially folded along the connecting member.

In operation, structure 10 is employed in the position shown in FIG. 1 in its flattened condition to support a user. When structure 10 is to be transported or placed in a more compact position, section 12 is folded relative to section 14 according to directional arrow 26 on FIG. 2. It should be noted that upper surfaces 20 and 26 of sections 12 and 14, respectively will contact each other when structure 10 is in a fully folded position (not shown). Connecting member 38 and the discontinuity of perimeter rods 50, 52, 58, and 60 permit the free folding of mattress structure 10. These structures further add support to plurality of springs 16 and 18 in sections 12 and 14, respectively, since connecting member 38 extends completely along ends 30 and 32 of sections 12 and 14, respectively.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A folding mattress structure, comprising:

a. a first section, said first section including a first side, a second side, and a plurality of springs spanning said first and second sides forming an end between said first and second sides;

b. a second section, said second section including a first side, a second side, and a plurality of springs spanning said first and second sides forming an end between said first and second sides;

c. a first rod fastened to at least one of plurality of springs of said first section, said first rod terminating at said end of said first section;

d. a second rod fastened to at least one of said plurality of springs of said second section, said second rod terminating at said end of said second section to provide a discontinuity between said first and second rods;

e. a connecting member spaced apart from said first and second rods and extending along the entire dimension of said ends of said first and second sections; and f. means for linking said connecting member to said plurality of springs of said first section along said end thereof and said plurality of springs of said second section along said end thereof, said connecting member permitting pivoting of said first section relative to said second section.

2. The structure of claim 1 in which said means for linking said connecting member to said springs of said first and second sections comprises an elongated member wrapped about portions of each said plurality of springs of said first and second sections, said plurality of springs of said first and second sections comprising a multiplicity of pairs of springs each formed by a first spring in said first section overlapping a second spring in said second section.

3. The structure of claim 1 which additionally includes a plurality of cross-members linking said plurality of springs of said first and second section to one another.

4. The structure of claim 3 in which said means for linking said connecting member to said springs of said first and second sections comprises an elongated member wrapped about portions of each said plurality of springs of said first and second sections, said plurality of springs of said first and second sections comprising a multiplicity of pairs of springs each formed by a first spring in said first section overlapping a second spring in said second section.

* * * * *